US010093458B2

(12) United States Patent
Stave et al.

(10) Patent No.: US 10,093,458 B2
(45) Date of Patent: Oct. 9, 2018

(54) RESEALABLE CHILD-DETERRENT BAG

(71) Applicant: HENKEL IP & HOLDING GMBH, Düsseldorf (DE)

(72) Inventors: Robert Stave, Ridgefield, CT (US); Michael Daoust, Sandy Hook, CT (US)

(73) Assignee: Henkel IP & Holding GmbH (DE)

( * ) Notice: Subject to any disclaimer, the term of this patent is extended or adjusted under 35 U.S.C. 154(b) by 0 days.

(21) Appl. No.: 15/060,263

(22) Filed: Mar. 3, 2016

(65) Prior Publication Data

US 2017/0253386 A1 Sep. 7, 2017

(51) Int. Cl.
*B65D 33/16* (2006.01)
*B65D 33/25* (2006.01)

(52) U.S. Cl.
CPC .. *B65D 33/2533* (2013.01); *B65D 2101/0015* (2013.01); *B65D 2215/04* (2013.01); *B65D 2215/08* (2013.01)

(58) Field of Classification Search
CPC ..... B65D 33/2566; B65D 33/2533; B65D 75/5805; B65D 75/008; B65D 33/007; B65D 33/24; B65D 2215/04; B65D 2215/08
USPC ..... 383/63, 65, 203, 204, 61.1, 61.2, 5, 104
See application file for complete search history.

(56) References Cited

U.S. PATENT DOCUMENTS 4,528,224 A 7/1985 Ausnit
4,756,414 A * 7/1988 Mott ..... B32B 7/02 206/720
4,844,759 A 7/1989 Boeckmann
5,067,822 A 11/1991 Wirth et al.
5,443,154 A * 8/1995 Hustad ..... B65D 75/326 206/213.1
5,711,609 A 1/1998 Simonsen
5,972,396 A * 10/1999 Jurgovan ..... B65D 33/2533 206/810
6,550,965 B2 4/2003 Shaffer et al.
6,962,439 B2 * 11/2005 Taheri ..... B65D 33/004 383/204
8,398,306 B2 * 3/2013 Kinigakis ..... B65D 33/20 383/203
2004/0013323 A1 * 1/2004 Withers ..... B65D 33/007 383/63
2009/0065382 A1 3/2009 Perri et al.
2012/0045151 A1 2/2012 Eouzan
2013/0195385 A1 8/2013 Matias
2013/0266243 A1 * 10/2013 Kinigakis ..... B65D 33/20 383/9
2014/0161374 A1 6/2014 Septien Rojas et al.
2014/0270585 A1 9/2014 Heckman
2014/0270596 A1 9/2014 Dowler et al.
2015/0010252 A1 * 1/2015 Yeager ..... B65D 31/10 383/210

* cited by examiner

*Primary Examiner* — Jes F Pascua
(74) *Attorney, Agent, or Firm* — Bojuan Deng

(57) ABSTRACT

A resealable bag is provided. The bag may include a resealable closure configured to make it difficult for a child to open the bag. The resealable closure may be disposed on a pair of flanges attached to an interior of the bag. In some embodiments, a user may need to grasp the flanges near the resealable closure in order to open the bag. This may provide a user an advantage when trying to prevent children from accessing the contents of the bag.

14 Claims, 8 Drawing Sheets

RESEALABLE CHILD-DETERRENT BAG

FIELD

Embodiments of the present disclosure relate to a bag with a resealable closure. In some embodiments, the bag may be configured to be difficult for specific users (e.g., children) to open.

BACKGROUND

Bags may be used for storing and/or transporting items. In some cases, bags will have an opening on the upper end of the bag that allows a user to access the contents of the bag. In some instances, the bag may include a closure mechanism to contain and/or preserve contents within the bag stored until a user wants to access the bag. In some cases, the closure mechanism may be a resealable closure mechanism.

SUMMARY

Some embodiments are directed to a resealable bag having a first sidewall, a second sidewall connected to the first sidewall to form a closed bottom, where the sidewalls are coupled together along their side edges and extend upwardly from the closed bottom to form an upper end of the bag. The resealable bag may include a tamper-evident seal disposed along the upper end of the bag and a resealable closure disposed along interior surfaces of the first and second sidewalls between 1 inch to 2 inches below a lowermost edge of the tamper-evident seal. The resealable closure may include a female component coupled to the first sidewall and a male component coupled to the second sidewall.

In some embodiments, the resealable bag may include a first flange coupled to the first sidewall and a second flange coupled to the second sidewall, the first flange having an upper edge and a bottom edge, the upper edge of the first flange being disposed at least 0.5 inches from the lowermost edge of the tamper-evident seal, the first flange being continuously sealed to the first sidewall between the upper edge and the bottom edge of the first flange, the second flange having an upper edge and a bottom edge, the upper edge of the second flange being disposed at least 0.5 inches from the lowermost edge of the tamper-evident seal, the second flange being continuously sealed to the second sidewall between the upper edge and the bottom edge of the second flange, and where a female component of a resealable closure is disposed on the first flange and a male component of the resealable closure is disposed on the second flange.

In some embodiments, the resealable bag may include a resealable closure composed of two or more female components coupled to the first sidewall and two or more male components coupled to the second sidewall.

In some embodiments, the resealable bag may be airtight.

In some embodiments, the resealable bag may include a first sidewall and a second sidewall that comprise a plastic material.

In some embodiments, the resealable bag may include at least two gussets disposed at the closed bottom of the bag and configured to support the bag in an upright position.

In some embodiments, the resealable bag may include a resealable closure that includes a zipper.

In some embodiments, the resealable bag may include a first interior set of ridges disposed on the first flange below the female component and spaced apart from each other by a first distance and a first exterior set of ridges disposed on the first flange above the female component and spaced apart from each other by a second distance. In some embodiments, the resealable bag may include a second interior set of ridges disposed on the second flange below the male component and spaced apart from each other by the first distance and a second exterior set of ridges disposed on the second flange above the male component and spaced apart from each other by the second distance. In some embodiments, the first distance may be less than the second distance.

In some embodiments, the resealable bag may include a female component and a male component that extend substantially further from the first and second flanges, respectively, than the interior and exterior ridges, so that a space is created between the flanges when the male and female components of the closure are engaged.

In some embodiments, the tamper-evident seal may be coupled to the first sidewall and the second sidewall by a structurally weakened region. In some embodiments, the resealable bag may include that the structurally weakened region comprises a laser scored line of perforation.

In some embodiments, the resealable bag may include a tear notch disposed adjacent to the structurally weakened region.

In some embodiments, the resealable bag may include a resealable closure located at a position that it makes it difficult for a child to view and reach the resealable closure so that the bag is made resistant to opening by a child.

In some embodiments, the resealable bag may include a resealable closure and a tamper-evident seal that extend substantially parallel to each other across the width of the resealable bag. In some embodiments, the resealable bag may include a resealable closure and a tamper-evident seal that extend substantially perpendicular to a length of the resealable bag.

In some embodiments, a vertical distance between the tamper-evident seal and the resealable closure may be greater than a vertical distance from a top end of the tamper-evident seal to a bottom end of the tamper-evident seal.

In some embodiments, a vertical distance between the tamper-evident seal and the resealable closure may be greater than a vertical distance from a top end of the resealable closure to a bottom end of the resealable closure.

In some embodiments, a product may be disposed within the resealable bag. In some embodiments, the product may be a laundry detergent.

In some embodiments, the first flange and the second flange may increase child-deterrence by increasing the pull strength required to open the resealable bag.

In some embodiments, the resealable closure may be disposed closer to a bottom edge of the first flange and a bottom edge of the second flange than an upper edge of the first flange and an upper edge of the second flange, respectively.

Some embodiments are directed to a method of making a resealable bag including: disposing a resealable closure on a first sidewall and a second sidewall, the resealable closure including a female component coupled to the first sidewall and a male component coupled to the second sidewall, where the female component is configured to couple with the male component to form an airtight seal; forming a pouch defined by the first sidewall, the second sidewall, and a closed bottom, the pouch comprising an upper end defined by the first sidewall and the second sidewall; and forming a tamper-evident seal at the upper end of the pouch. In some embodiments, a lowermost edge of the tamper-evident seal may be disposed 1 to 2 inches above the resealable closure.

In some embodiments, forming the tamper-evident seal may include forming a structurally weakened region at the upper end of the pouch. In some embodiments, forming the structurally weakened region may include perforating the first sidewall and the second sidewall to make a tamper-evident seal. In some embodiments, perforating the first sidewall and the second sidewall may be performed by a laser scoring process.

In some embodiments, the method may include disposing a male component of the resealable closure 1 to 2 inches downward from the lower edge of the tamper-evident seal on the first sidewall and disposing a female component of the resealable closure 1 to 2 inches downward from the lower edge of the tamper-evident seal on the second sidewall.

In some embodiments, the female component may be disposed on a first flange and the male component may be disposed on a second flange.

Some embodiments are directed to a child resistant resealable bag including a hollow interior defined by a pair of sidewalls connected on at least their bottom and side edges, the side edges extending upwardly from the bottom to form an upper end of the bag and defining an opening at the upper end of the bag. The child resistant resealable bag may include a resealable closure disposed along interior surfaces of the pair of sidewalls between 1 inch to 2 inches below the opening, the resealable closure configured to form an air-tight seal.

In some embodiments, the child resistant resealable bag includes a pair of flanges having a first flange disposed on the first sidewall and a second flange disposed on the second sidewall. The child resistant resealable bag may include a female component of the resealable closure disposed on the first flange and a male component of the resealable closure disposed on the second flange. In some embodiments, the pair of flanges may extend substantially parallel to each other between the side edges of the first sidewall and the second sidewall.

BRIEF DESCRIPTION OF THE DRAWINGS/FIGURES

DETAILED DESCRIPTION

Figure 1:
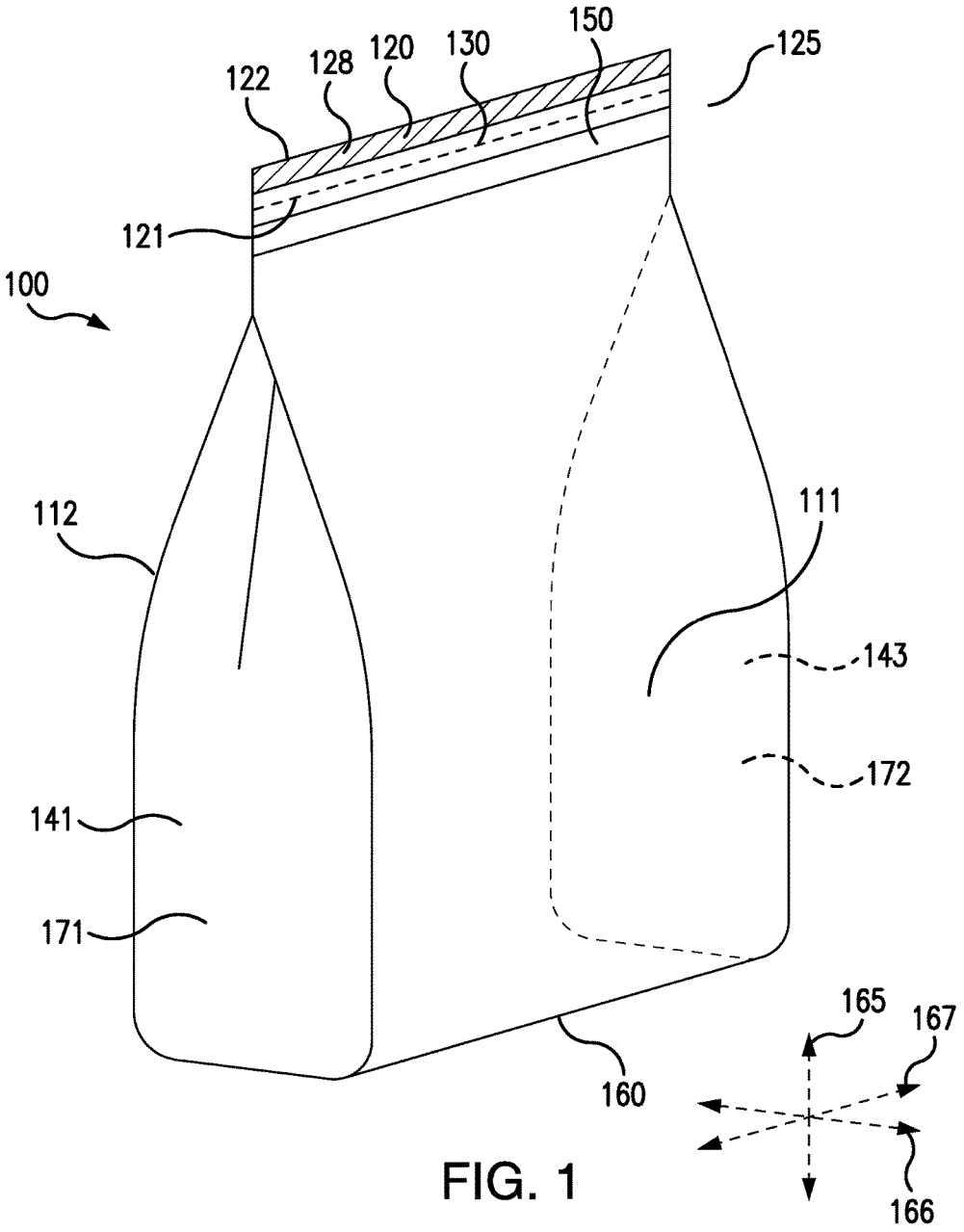
FIG. 1 shows a perspective view of a resealable bag according to an embodiment.
Figure 2B:
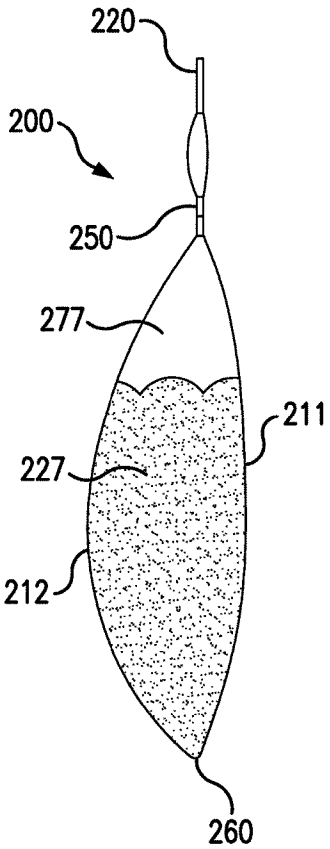
FIG. 2B shows a cross-sectional view along the line 2-2' in FIG. 2A.
Figure 2A:
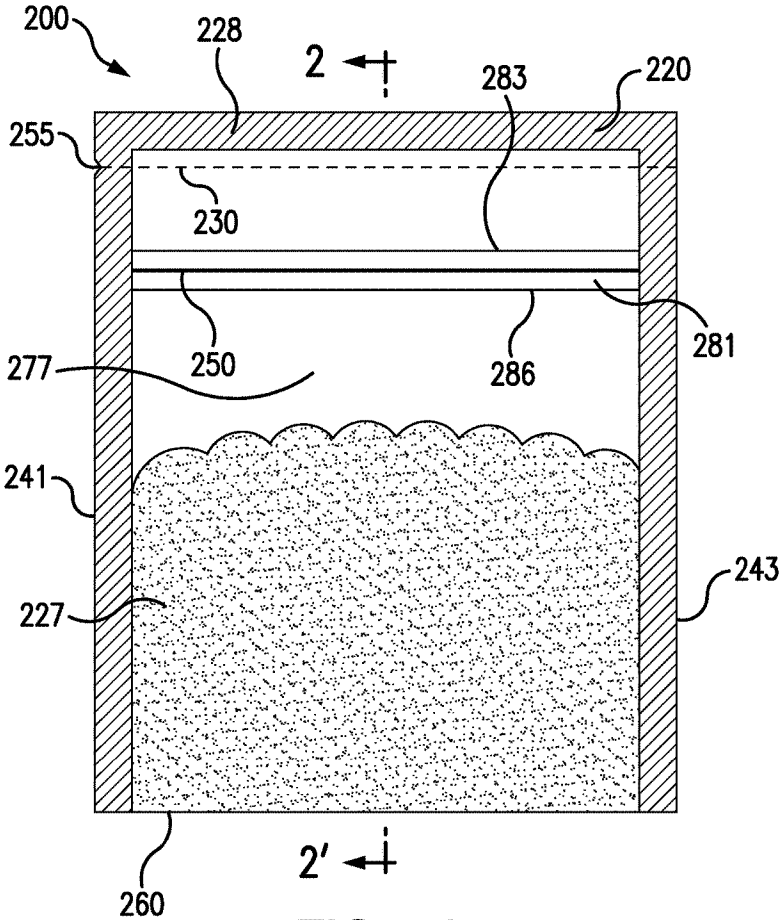
FIG. 2A shows a plan view of a bag according to an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Bags according to embodiments discussed herein may be used to protect, hold, and/or transport products. In some cases a user may desire a bag that is resealable via manipulation of a resealable closure mechanism located on an upper end of a bag. But, while resealability may be desirable, a user may also want to ensure that particular individuals (e.g., children) are inhibited from accessing the contents of the bag (e.g., to protect them from potentially dangerous contents of the bag or from accessing contents they are forbidden from having). Keeping potentially dangerous products away from children may be a concern for parents and/or caregivers. For example, in some instances, the contents of the bag may pose health risks if consumed by a child/baby.

The location of a resealable closure mechanism relative to an upper end of the bag may serve to inhibit a child from easily opening a resealable bag. In some embodiments, a resealable closure mechanism may be located at a distance below the upper edge of a resealable bag such that it is concealed from view and/or difficult for a child to reach with his or her fingers. In some embodiments, the resealable closure may be located at a distance between 1 inch to 2 inches below the upper edge of a bag. Such a distance may make it difficult for a child to recognize the resealable closure and/or effectively grasp and manipulate the resealable closure while not making manipulation of the resealable closure exceedingly difficult for other users.

The resealable closure mechanism according to embodiments discussed herein may inhibit a child from easily opening a resealable bag without significantly increasing the weight of a bag or increasing the complexity of manufacturing a bag. A lightweight bag may be beneficial for, among other things, keeping shipping costs low. Additionally, simplicity in manufacturing may reduce manufacturing costs.

These and other embodiments are discussed below with reference to the figures. However, those skilled in the art will readily appreciate that the detailed description given herein with respect to these figures is for explanatory purposes only and should not be construed as limiting.

Some embodiments include a bag 100 for protecting, holding, and/or transporting one or more products. FIG. 1 shows bag 100 according to some embodiments. In some embodiments, bag 100 may include a first sidewall 111 and a second sidewall 112. In some embodiments, first sidewall 111 and second sidewall 112 are connected to form a closed bottom 160. In some embodiments, first sidewall 111 and second sidewall 112 may be coupled together along their side edges (i.e., a first side edge 141 and a second side edge 143). First sidewall 111 and second sidewall 112 may extend upwardly (e.g., in a vertical direction 165 (i.e., height) of bag 100) from closed bottom 160 to form an upper end 125 of bag 100. In some embodiments, first sidewall 111 and second sidewall 112 may define a portion of upper end 125 of bag 100. In some embodiments, closed bottom 160, first sidewall 111, and second sidewall 112 may define the top and sides of a hollow interior (e.g., a pouch) of bag 100. In some embodiments, upper end 125 of bag 100 may be the same as or similar to an upper end 425 of a bag 400 discussed below in regards to FIGS. 4 and 5.

Bag 100, and portions thereof (e.g., sidewalls 111/112 and closed bottom 160), may be composed of one or more sheets, foils, woven materials, films, laminates, composites, or combinations thereof. Bag 100 may be made from any suitable material including natural or synthetic materials, such as but not limited to a plastic, a paper product (e.g. cardboard or paperboard), or combinations thereof. Suitable plastics for bag may be a plastic monolayer or laminated film structure which may include, but not limited to polyethylene terephthalate (PET), polyester, polyethylene, polypropylene, or a blend or co-polymer thereof.

Bag 100 may be flexible or rigid. The thickness of first sidewall 111 and second sidewall 112 may be varied to provide desirable characteristics (e.g., gas or water permeability, rigidity/flexibility, or puncture resistance). In some embodiments, bag 100, or portions thereof, may be composed of a laminated material comprising different material types in order to provide a variety of characteristics including, for example, gas or water impermeability or structural rigidity/flexibility. In some embodiments, first sidewall 111 may be made of a different material than second sidewall 112. In some embodiments, first sidewall 111 and second sidewall 112 may be made of different materials than the other portions of bag 100 (e.g., closed bottom 160 or a resealable closure 150). In some embodiments, first sidewall 111 and second sidewall 112 may comprise a plastic material.

In some embodiments, first sidewall 111 and second sidewall 112 may be directly coupled to each other along first side edge 141 and second side edge 143 (e.g., using an heat seal and/or an adhesive). In some embodiments, first sidewall 111 and second sidewall 112 may be coupled together along at least a portion of their heights via a first side panel 171 and a second side panel 172. First side panel 171 may couple first sidewall 111 to second sidewall 112 on one side of bag 100, and second side panel 172 may couple first sidewall 111 to second sidewall 112 on the opposite side of bag 100. In some embodiments, first side panel 171 and second side panel 172 may provide bag 100 with a certain depth in a first horizontal direction 166 (e.g., may increase the depth of bag 100). The height, width, and depth of bag 100 may be tailored based on at least the type and/or amount of product contained within bag 100. As a non-limiting example, bag 100 may have a width (measured in a second horizontal direction 167) in a range between 5 inches to 15 inches. As another non-limiting example, bag 100 may have a height (measured in vertical direction 165) in a range between 5 inches to 20 inches. As another non-limiting example, bag 100 may include a depth in the range between 1 inch to 10 inches.

First sidewall 111 and second sidewall 112 may be sealed together along any portion of bag 100. In some embodiments, first sidewall 111 and second sidewall 112 may be formed of a single continuous sheet of material sealed to form side edges 141/143 and sealed at upper end 125 and/or closed bottom 160 of bag 100. In some embodiments, the sheet of material may be folded or gusseted at one end (e.g., extend continuously around one end) and be sealed at the opposite end (e.g., via a seal area).

In some embodiments, bag 100 may include a tamper-evident seal 120 disposed along upper end 125 of bag 100. Tamper-evident seal 120 may extend along the width of bag 100 (i.e., in second horizontal direction 167) between first side edge 141 and second side edge 143. In some embodiments, tamper-evident seal 120 may extend along the width of bag 100 (i.e., in second horizontal direction 167) from first side edge 141 to second side edge 143. Tamper-evident seal 120 may include an uppermost edge 122 that defines an upper edge of bag 100 when tamper-evident seal 120 is attached to bag 100. In some embodiments, uppermost edge 122 may define an upper end of a seal area 128 of tamper-evident seal 120. In some embodiments, seal area 128 may make tamper-evident seal 120 and bag 100 airtight. In such embodiments, seal area 128 may help protect against entry of contaminates (e.g., humidity or microorganisms) into bag 100 or departure of substances (e.g., inert air) from bag 100 until tamper-evident seal 120 is detached from bag 100. In some embodiments, seal area 128 may protect the contents of bag 100 from being undesirably activated due to contact with water or air (e.g., may prevent undesirable chemical reactions within bag 100). In some embodiments, seal area 128 may have a height measured in vertical direction 165 in the range between ⅛ of an inch to ½ of an inch. In some embodiments, temper evident seal 120 may be removable.

Tamper-evident seal 120 may include a lowermost edge 121 that is spaced apart from the uppermost edge 122 in vertical direction 165. In some embodiments, lowermost edge 121 of tamper-evident seal 120 may be defined by a structurally weakened region 130. Structurally weakened region 130 may allow tamper-evident seal 120 to be removed from upper end 125 of bag 100 so that a user can access to the contents of bag 100. Structurally weakened region 130 may be formed by making a region at upper end 125 of bag 100 rupturable, frangible, tearable, or otherwise manually breachable. Structurally weakened region 130 may allow a user to open bag 100 without the use of a scissors or a knife. In some embodiments, structurally weakened region 130 may include a line of perforation. In some embodiments, structurally weakened region 130 may be created by laser scoring (e.g., laser scoring a line of perforation). In some embodiments, tamper-evident seal 120 may be additionally or alternatively cut off by a user.

Structurally weakened region 130 may be disposed below uppermost edge 122 of tamper-evident seal 120 in vertical direction 165 towards closed bottom 160 of bag 100. In some embodiments, structurally weakened region 130 may be disposed between ⅛ of an inch to 2 inches from uppermost edge 122.

A resealable closure 150 may be disposed along the interior surfaces of first sidewall 111 and second sidewall 112. In some embodiments, resealable closure 150 may be disposed 1 inch or more from lowermost edge 121 of tamper-evident seal 120. In some embodiments, resealable closure 150 may be disposed between 1 to 2 inches from lowermost edge 121 of tamper-evident seal 120. Resealable closure 150 may extend along the width of bag 100 (i.e., in second horizontal direction 167) between first side edge 141 and second side edge 143. In some embodiments, resealable closure 150 may extend along the width of bag 100 (i.e., in second horizontal direction 167) from first side edge 141 to second side edge 143. In some embodiments, resealable closure 150 may be configured to form an airtight seal. In some embodiments, resealable closure 150 and tamper-evident seal 120 may extend substantially parallel to each other across the width of bag 100. In some embodiments, resealable closure 150 and tamper-evident seal 120 may extend substantially perpendicular to the height of bag 100. Resealable closure 150 may be made of a plastic material, such as but not limited to polyethylene or polypropylene. In some embodiments, resealable closure 150 may be airtight when resealable closure 150 is closed (e.g., sealed).

Resealable closure 150 may include a suitable resealable fastener such as but not limited to a zipper (e.g., a Ziploc® zipper), interlocking rib and groove elements, tape, hook and loop fasteners (e.g., Velcro®), or a similar closure mechanism. Resealable closure 150 may include one or more resealable fasteners. In some embodiments, resealable closure 150 may include one to three fasteners. In some embodiments, resealable closure 150 may include two fasteners. When multiple fasteners are used for resealable closure 150 they may be spaced apart in vertical direction 165 (e.g., by 1/16 of an inch to 1/3 of an inch). If resealable closure 150 includes more than two resealable fasteners, the spacing between adjacent resealable fasteners may be the same or may be different. Multiple resealable fasteners may provide enhanced seal strength for greater packaging integrity during the lifetime of bag 100. In some embodiments, resealable closure 150 may be the same as or similar to resealable closure 450 discussed herein.

FIGS. 2A-3B show a bag 200 according to an embodiment. Bag 200 may house a product 227 within a hollow interior 277 of bag 200. Hollow interior 277 may be defined by a first sidewall 211, a second sidewall 212, and a closed bottom 260 of bag 200. First sidewall 211 and second sidewall 212 may extend from closed bottom 260 and may be coupled together at a first side edge 241 and a second side edge 243. In some embodiments, product 227 may be a cleaning product. The cleaning product may be, but is not limited to, a detergent (e.g., a laundry detergent or a dish washing detergent) or a soap. In some embodiments, product 227 may be a fabric softener. In some embodiments, product 227 may be in the form of a powder, flakes, granules, a gel, a liquid, a particulate, or a combination thereof. In some embodiments, product 227 may be encased in individual pods, pouches, or other similar encapsulated structures. In some embodiments, product 227 may be a food product (e.g., deli meat, prepared food, frozen food, poultry, cheese, or pet food and treats). In some embodiments, product 227 may be a cosmetic product.

Bag 200 may include a resealable closure 250. Resealable closure 250 may be disposed on interior surfaces 207 of first sidewall 211 and second sidewall 212 between 1 to 2 inches below an opening 278 at an upper end of bag 200. In some embodiments, resealable closure 250 may include a female component and a male component coupled to interior surfaces 207 of first sidewall 211 and second sidewall 212, respectively (or vice versa) (see e.g., FIG. 3B). In some embodiments, resealable closure 250 may be configured to form an airtight seal. In such embodiments, the female component may be configured to couple with the male component to form the airtight seal.

In some embodiments, resealable closure 250 may include a female (or male) component disposed on a first flange 281 that is coupled to interior surface 207 of first sidewall 211. In some embodiments, resealable closure 250 may include a male (or female) component disposed on a second flange 282 that is coupled to interior surface 207 of second sidewall 212. First flange 281 may have an upper edge 283 and a lower edge 286 and second flange 282 may have an upper edge 284 and a lower edge 287 (see e.g., FIG. 3B). In some embodiments, resealable closure 250 may be the same as or similar to resealable closure 450.

In some embodiments, bag 200 may include a tamper-evident seal 220 and a structurally weakened region 230 the same as or similar to tamper-evident seal 120 and structurally weakened region 130, respectively. In some embodiments, a tear notch 255 may be disposed below a seal area 228 of tamper-evident seal 220 and may be located adjacent to structurally weakened region 230 in order to ease the separation of tamper-evident seal 220 from bag 200.

Figure 3B:
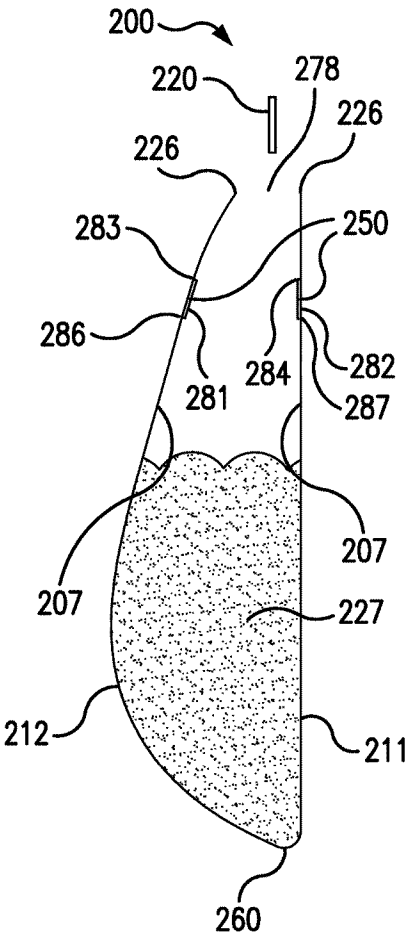
FIG. 3B shows a cross-sectional view along the line 3-3' in FIG. 3A.
Figure 3A:
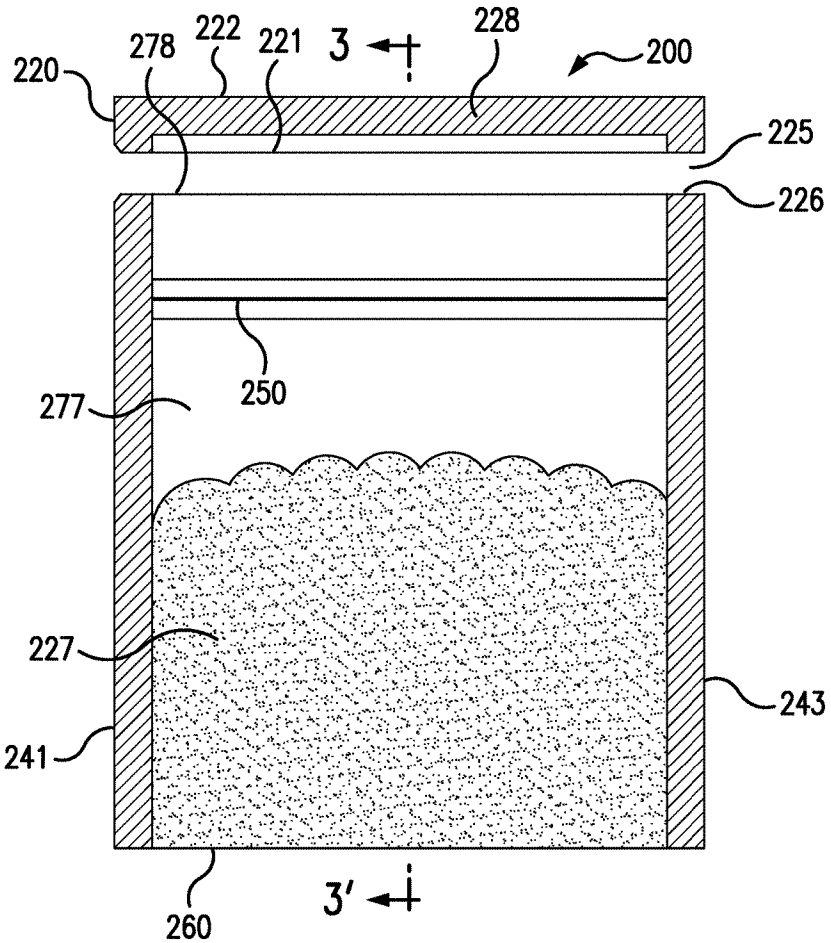
FIG. 3A shows a plan view of a bag according to an embodiment.

FIG. 3A shows a plan view of bag 200 according to an embodiment with movable seal 220 detached from bag 200. As shown in FIG. 3A, tamper-evident seal 220 comprises an uppermost edge 222 and a lowermost edge 221. In some embodiments, tamper-evident seal 220 may be removable. Lowermost edge 221 of tamper-evident seal 220 may be removably coupled to an upper edge 226 of bag 200 defining opening 278 at an upper end 225 of bag 200. When tamper-evident seal 220 is detached from bag 200, opening 278 of bag 200 may be exposed to allow access to product 227 disposed in hollow interior 277. In some embodiments, first side edge 241 and a second side edge 243 may define opening 278 at upper end 225 of bag 200.

When resealable closure 250 is located at certain distances from upper edge 226 of bag 200, opening of bag 200 may be inhibited (e.g., made more difficult for some users, e.g., children)) while simultaneously not making manipulation of resealable closure 250 exceeding difficult for other users. This may be advantageous when trying to protect little children from the contents of bag 200 (e.g., product 227). The location of resealable closure 250 may inhibit the ability of a child to see resealable closure 250, thereby making it difficult for the child to know where and/or how to open bag 200. Further, by locating resealable closure at certain distances from upper edge 226 of bag 200, it may be difficult for small children to grab bag 200 near resealable closure 250 (e.g., because of his or her small fingers). Without the ability to grab bag 200 close to resealable closure 250, opening bag 200 may be more challenging.

First sidewall 211 and second sidewall 212 may be sealed together along any portion of bag 200. In some embodiments, first sidewall 211 and second sidewall 212 may be formed of a single continuous sheet of material sealed to form side edges 241/243 and sealed at upper end 225 and/or closed bottom 260 of bag 200. In some embodiments, the sheet of material may be folded or gusseted at one end (e.g., extend continuously around one end) and be sealed at the opposite end (e.g., via a seal area).

Figure 4:
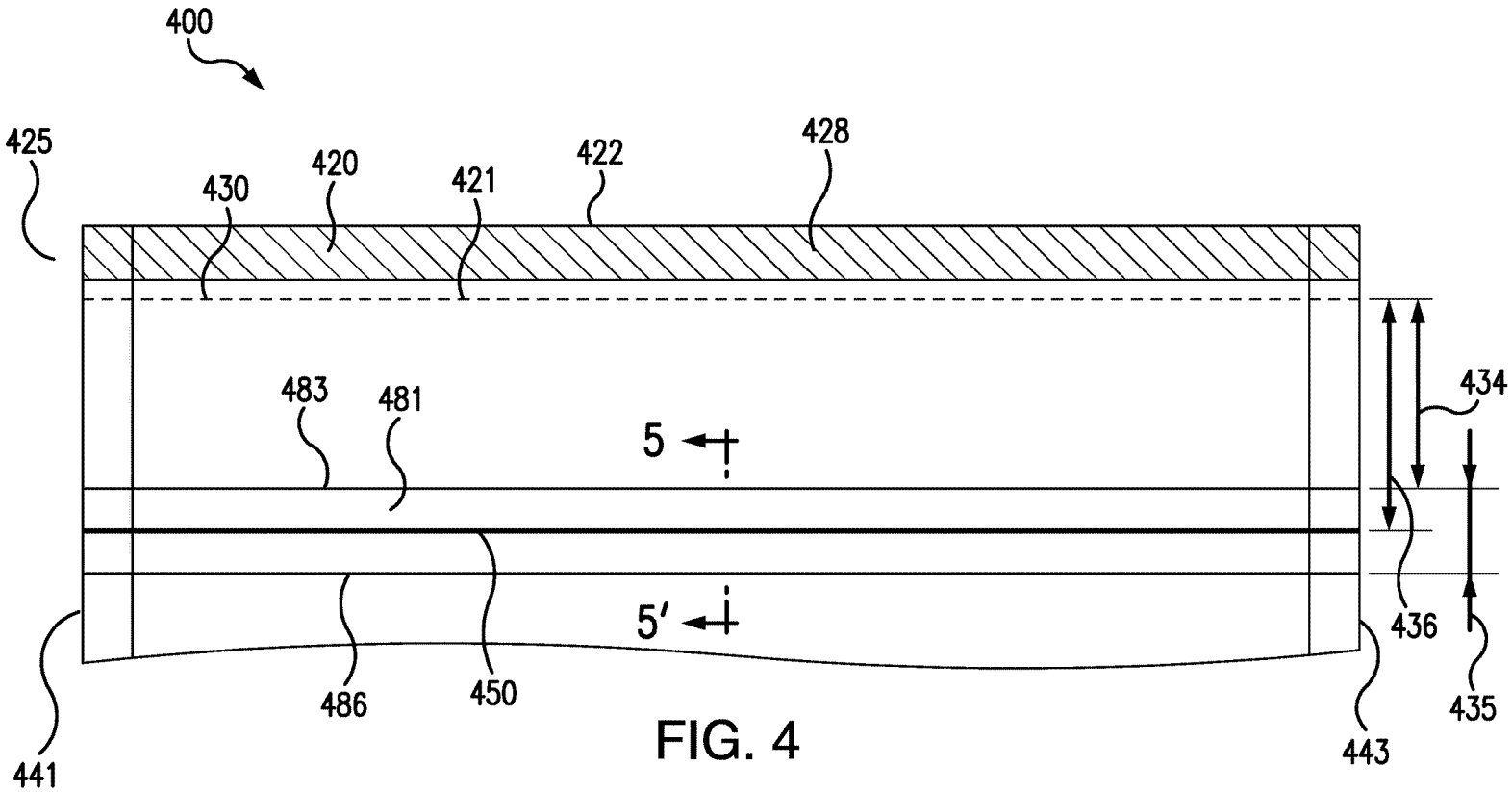
FIG. 4 shows an upper portion of a bag according to an embodiment.
Figure 5:
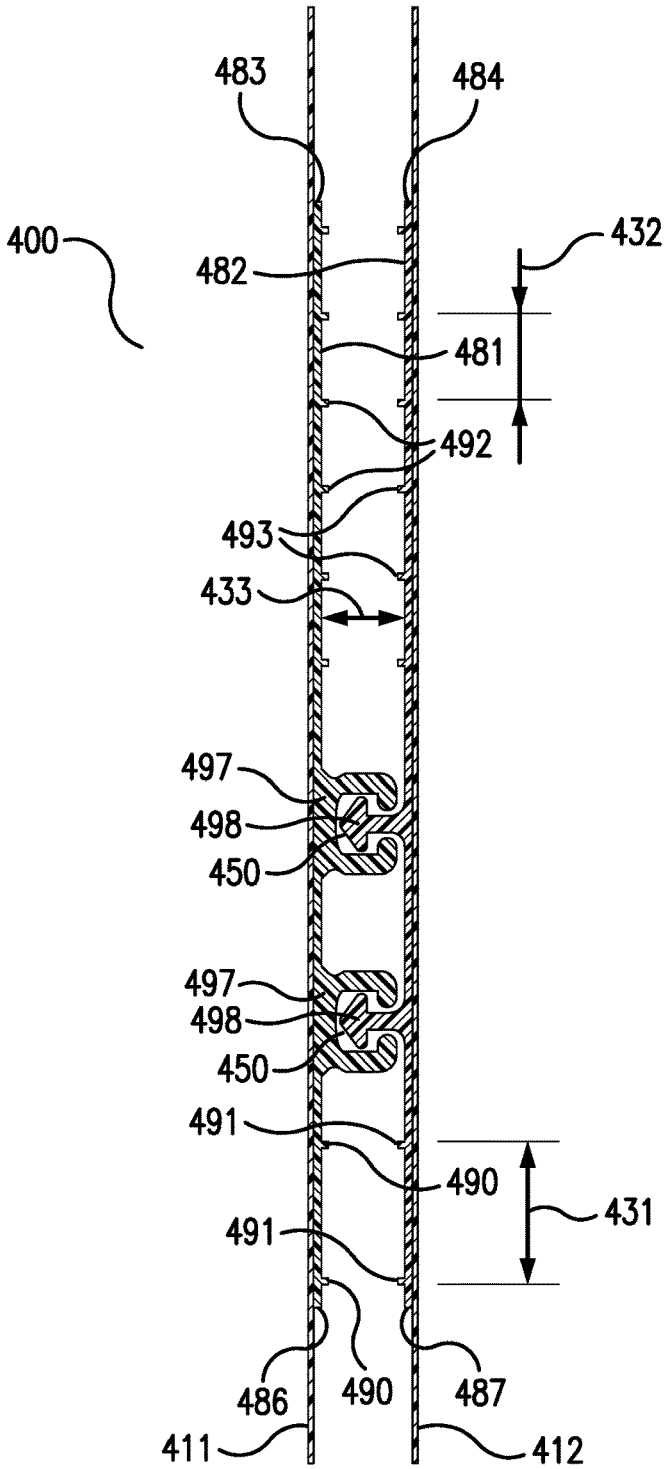
FIG. 5 shows a cross-sectional view along the line 5-5' in FIG. 4.

FIG. 4 shows upper end 425 of bag 400 having elements (e.g., resealable closure 450 and a seal area 428) positioned (i.e., located) in an arrangement that inhibits the ability of a child to open a bag according to an embodiment. Similar to bags 100 and 200, bag 400 may include a tamper-evident seal 420 having an uppermost edge 422 and a lowermost edge 421. In some embodiments, tamper-evident seal 420 may be removable. Similar to bags 100 and 200, lowermost edge 421 of tamper-evident seal 420 may be removably coupled to an upper edge of the bag that defines an opening (e.g., opening 278) at upper end 425 of bag 400. As shown in FIG. 5, resealable closure 450 may include a female component 497 disposed on a first flange 481 coupled to a first sidewall 411 and a male component 498 disposed on a second flange 482 coupled to a second sidewall 412. In some embodiments, female component 497 may be configured to couple with male component 498 to form an airtight seal.

As shown in FIG. 4, a lowermost edge 421 of a tamper-evident seal 420 may be located at a first vertical distance 434 (measured in vertical direction 165) from an upper edge 483 of first flange 481. In some embodiments, first vertical distance 434 may be at least 0.5 inches. In some embodiments, first vertical distance 434 may be in the range of 0.5 to 2.0 inches. In some embodiments, first vertical distance 434 may be in the range of 0.5 to 1.5 inches. Lowermost edge 421 may be located at the same distance from an upper edge 484 of second flange 482. Locating lowermost edge 421 of tamper-evident seal 420 at first vertical distance 434 from upper edge 483 of first flange 481 may diminish a child's ability to open bag 400 by inhibiting the child's inability to see a resealable closure 450 and making it more difficult for the child's small fingers to reach resealable closure 450.

As shown in FIG. 4, upper edge 483 of first flange 481 may be located a second vertical distance 435 from a lower edge 486 of first flange 481. In some embodiments, second vertical distance 435 may be at least 0.5 inches. In some embodiments, second vertical distance 435 may be in the range of 0.5 to 1.5 inches. In some embodiments, second vertical distance 435 may be in the range of 0.7 to 1.1 inches. Second flange 482 may have the same dimensions as first flange 481. By varying the height of first flange 481 and/or second flange 482, the ability to open bag 400 may be impacted. In some embodiments, vertical distance 435 may affect how first sidewall 411 and second sidewall 412 may be pulled apart from one another and how the pulling force is applied to resealable closure 450.

As shown in FIG. 4, a structurally weakened region 430 (which corresponds to the open end of the bag 400 when tamper-evident seal 420 is removed) may be located a third vertical distance 436 from resealable closure 450. In some embodiments, third vertical distance 436 may be at least 1 inch. In some embodiments, third vertical distance 436 may be in the range 1 to 2 inches. In some embodiments, third vertical distance 436 may be in the range of 1.5 to 1.75 inches. Third vertical distance 436 may provide similar benefits as previously described for first vertical distance 434. In some embodiments, third vertical distance 436 may be greater than second vertical distance 435.

Spacing resealable closure 450 at least 1 inch from structurally weakened region 430 but no more than 2 inches from structurally weakened region 430 inhibits a child's ability to effectively grasp and manipulate resealable closure 450 while not making manipulation of the resealable closure exceedingly difficult for other users. In embodiments including first and second flanges 481 and 482, disposing resealable closure 450 on first and second flanges 481 and 482 may provide mechanical resistance to opening bag 400 unless first and second flanges 481 and 482 are pulled. Requiring first and second flanges 481 and 482 to be pulled may provide additional child deterrence for bag 400 by increasing the minimum pull strength required to open bag 400.

The effect of third vertical distance 436 on the ease of opening a bag was tested to determine what impact it has on deterring children from opening a bag. Children were tested on their ability to open three different bags, each bag having a zipper (resealable closure 450) located at a different vertical distance 436. The other dimensions of all the bags tested were the same. Eleven young children participated in one-on-one interviews. A parent accompanied each child. Of the eleven children, there were five girls and six boys. There were four two-year olds, four three-year olds, and three five-year olds.

The first bag tested ("Control Bag") had a zipper located 0.3125 inches from the opening of the bag (i.e., a vertical distance 436 of 0.3125 inches). The second bag tested ("Child-deterrent Bag 1") had a vertical distance 436 of 1.0 inch. The third bag tested ("Child-deterrent Bag 2") had vertical distance 436 of 2.0 inches.

TABLE 1

Test Results for Bags Tested

| Bag Tested | Vertical Distance 436 (inches) | Opened on Own | Opened after Parent Showed |
|---|---|---|---|
| Control Bag | 0.3125 | 6/11 | 7/11 |
| Child-deterrent Bag 1 | 1.0 | 0/11 | 3/11 |
| Child-deterrent Bag 2 | 2.0 | 0/11 | 0/11 |

For Control Bag, six out of eleven children opened the bag on their own. And seven out of eleven children were able to open the bag after a parent showed them how to open the bag. For Child-deterrent Bag 1, three out of eleven children were able to open the bag after a parent showed them how to open the bag, but none of the children were able to open the bag without a parent showing them how to. For Child-deterrent Bag 2, none of the children were able to open the bag on their own and none of the children were able to open the bag after a parent showed them how to.

As illustrated by the tests, the location of the zipper on Child-deterrent Bag 1 was significantly more effective in preventing a child from opening a bag than the location of the zipper on Control Bag. The 1.0 inch vertical distance 436 for Child-deterrent Bag 1 proved much more difficult for children to maneuver in order to gain access to and figure out how to manipulate the zipper compared to the 0.3125 inch vertical distance 436 for Control Bag, and therefore made it much more difficult for the children to open Child-deterrent Bag 1. Further, the tests show that Child-deterrent Bag 2 is even less intuitive and more difficult for children to open than Child-deterrent Bag 1. The children were unable to open Children-deterrent Bag 2 regardless of whether or not a parent showed them how to open it. The relatively large vertical distance 436 (2.0 inches) of Child-deterrent Bag 2 proved most difficult for children to maneuver in order to gain access to and figure out how to manipulate the zipper on Child-deterrent Bag 2. The vertical distances 436 of Child-deterrent Bag 1 and Child-deterrent Bag 2 may also have prevented the children from being able to recognize the zipper in the first place and realize that it was the gateway to accessing the interior of the bags.

While Child-deterrent Bag 2 was most difficult for the children to open, it was not difficult for the parents open. The parents were able to intuitively find the right way to open Child-deterrent Bag 1 and Child-deterrent Bag 2. In addition to being the only the bag tested that none of the children could open, the parents could easily open and close Child-deterrent Bag 2. In fact, the parents preferred Child-deterrent Bag 2 because the parents found Child-deterrent Bag 2 easier to both and open and close than the other tested bags. The tests revealed that parents found it more difficult to properly close Child-deterrent bag 1 compared to Child-deterrent Bag 1. And, while Control Bag was the easiest bag for children to open, the parents found Control Bag the most difficult to close. Ease for the parents in opening and properly closing a bag facilitates child deterrence because ease in properly closing a bag helps ensure that the zipper of the bag is properly sealed after each use by a parent.

At the end of the tests, the parents concluded that the zipper (resealable closure 450) being distanced from the top of the bag was a positive. The parents indicated that increasing the distance of resealable closure 450 from the top of the bag made it more difficult for children to maneuver the bag with their little hands. The parents found opening Child-deterrent Bag 1 and Child-deterrent Bag 2 slightly difficult at first. But once the parents figured out how to open the bags, they felt the bags could be easily opened and closed. For Child-deterrent Bag 2, parents liked how resealable closure 450 was hidden and how the vertical distance 436 of Child-deterrent Bag 2 made it possible for them to access resealable closure 450 for easy opening and proper closing. Overall, the parents liked Child-deterrent bag 2 more than Child-deterrent Bag 1. With Child-deterrent Bag 1, the parents felt that their child may see them open the bag because the vertical distance 436 of Child-deterrent Bag 1 may not as effectively conceal how to open resealable closure 450.

Furthermore, based on these tests, it was determined that locating resealable closure 450 over two inches from the top of the bag may make it noticeably harder for adults to open the bag while providing minimal returns for child deterrence. The parents indicated that locating resealable closure 450 too far from the top of a bag may make it more likely that they would be inclined to improperly use or open the bag. For example, the parents indicated they may be inclined to remove a portion of vertical distance 436 (e.g., by tearing and/or with scissors) if resealable closure 450 were located too far from the top of a bag. If the parents were to remove too much of the vertical distance 436, the benefits of having a longer vertical distance may be lost.

As such, the testing procedure helped determine the optimal vertical distance 436 for achieving child-deterrence without making opening and closing of a bag exceeding difficult or frustrating for an adult. Resealable closure 450 needs to be far enough from the top of the bag to provide child-deterrence. But, for adults, resealable closure 450 also needs to be close enough to the top of the bag in order to minimize bag handling difficulty and the chance of an adult removing a portion of vertical distance 436, e.g., by tearing or cutting, to more easily access the bag interior. Based on the tests performed, the optimal vertical distance 436 for achieving child-deterrence without burdening an adult is between 1 and 2 inches.

FIG. 5 shows a cross-sectional view along the line 5-5' in FIG. 4 showing an enlarged view of first flange 481, second flange 482, and resealable closure 450. Similar to first flange 481, second flange 482 has upper edge 484 and a lower edge 487. First flange 481 and second flange 482 may extend substantially parallel to each other between a first side edge 441 and a second side edge 442 of first sidewall 411 and second sidewall 412 (See e.g. FIG. 4). Resealable closure 450 may include one or more female components 497 disposed on first flange 481. Resealable closure 450 may include one or more male components 498 disposed on second flange 482. Alternatively, female component(s) 497 may be disposed on second flange 482, and male component (s) 498 may be disposed on first flange 481. In some embodiments, resealable closure 450 may include two male components 498 and two female components 497. In some embodiments, all female components 497 may be disposed on first flange 481, and all male components 498 may be disposed on second flange 482, or vice versa.

In some embodiments, the component of resealable closure 450 disposed on first flange 481 may be located closer to lower edge 486 than upper edge 483. Alternatively, the component of resealable closure 450 disposed on first flange 481 may be located closer to upper edge 483 than lower edge 486. In some embodiments, the component of resealable closure 450 disposed on first flange 481 may be equally spaced from lower edge 486 and upper edge 483. The component of resealable closure 450 disposed between upper edge 484 and lower edge 487 on second flange 482 may be similarly located as the component of resealable closure 450 on first flange 481.

First flange 481 and second flange 482 may be coupled and continuously sealed to first sidewall 411 and second sidewall 412, respectively. In some embodiments, the continuous seal of first flange 481 and second flange 482 may extend from upper edge 483 to lower edge 486 of first flange 481 and from upper edge 484 to lower edge 487 of second flange 482. In some embodiments, a portion of first flange 481 and/or second flange 482 may not be continuously sealed along first sidewall 411 and/or second sidewall 412. In some embodiments, the discontinuity of the seal may not be symmetrical between first flange 481 and second flange 482. For example, lower edge 486 of first flange 481 may be unsealed, and upper edge 484 of second flange 482 may be unsealed. By providing an asymmetric discontinuity of the seal, the difficulty of opening bag 400 may be increased.

In some embodiments, a first interior set of ridges 490 may be disposed on first flange 481 below female component 497. First interior set of ridges 490 may be spaced apart from each other by a first distance 431. In some embodiments, a first exterior set of ridges 492 may be disposed on first flange 481 above female component 497. First exterior set of ridges 492 may be spaced apart from each other by a second distance 432. In some embodiments, a second interior set of ridges 491 may be disposed on second flange 482 below male component 498. Second interior set of ridges 491 may be spaced apart from each other by first distance 431. In some embodiments, a second exterior set of ridges 493 may be disposed on second flange 482 above male component 498. Second exterior set of ridges 493 may be spaced apart from each other by second distance 432. First distance 431 and second distance 432 may be the same or different. First distance 431 may be greater than, less than, or equal to second distance 432. In some embodiments, first distance 431 may be more than 0.05 inches, between 0.10 inches and 0.20 inches, or 0.15 inches. In some embodiments, second distance 432 may be more than 0.02 inches, between 0.05 inches and 0.10 inches, or 0.08 inches.

In some embodiments, female component 497 and male component 498 may extend substantially further from first flange 481 and second flange 482 (i.e., in first horizontal direction 166) than first interior ridges 49, second interior ridges 491, first exterior ridges 492, and second exterior ridges 493. In some embodiments, a space 433 may be created between first flange 481 and second flange 482 when female component 497 and male component 498 are engaged. Space 433 allows a user to more readily place their fingers close to a resealable closure 450. Space 433 may be more than 0.010 inches, between 0.040 inches and 0.120 inches, or 0.078 inches.

Figure 6:
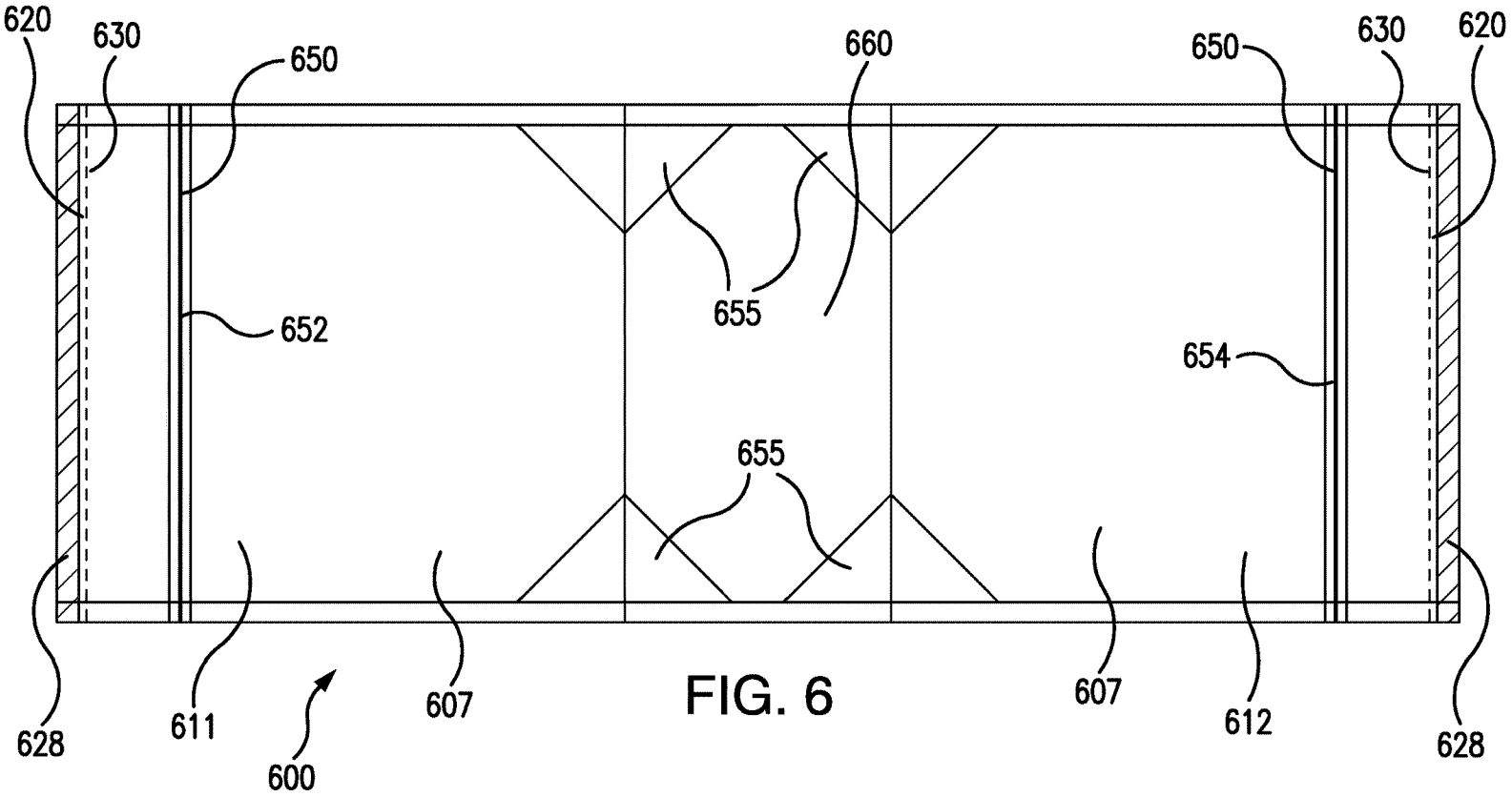
FIG. 6 shows a semi-finished bag according to an embodiment.

FIG. 6 depicts a semi-finished bag 600 composed of a first sidewall 611, a second sidewall 612, and a closed bottom 660. In some embodiments, first sidewall 611, second sidewall 612, and closed bottom 660 may be formed of a single sheet of material. A male component 652 and a female component 654 of a resealable closure 650 may be disposed on interior surfaces 607 of first sidewall 611 and second sidewall 612, respectively. Male component 652 and female component 654 may be used to make bag 600 resealable. A structurally weakened region 630 may be disposed adjacent to male component 652 and female component 654 of resealable closure 650 on opposite ends of semi-finished bag 600. Gussets 655 may be provided to influence the final shape of the semi-finished bag 600. Gusset 655 may be disposed at a location corresponding to closed bottom 660 and configured to support bag 600 in an upright position. Gussets 655 may help determine the shape of closed bottom 660.

First sidewall 611 and second sidewall 612 may be brought together and sealed along their edges to form a pouch with closed bottom 660. A seal area 628 on first sidewall 611 and second sidewall 612 may be disposed on bag 600. Contents may be added to bag 600 after bringing first sidewall 611 and second sidewall 612 together. Seal area 628 may be sealed together to form a tamper-evident seal 620 after contents are added to bag 600. In some embodiments, first sidewall 611 and second sidewall 612 may alternatively be brought together and sealed where the closed bottom 660 is located. In some embodiments, seal area 628 may be sealed to form an airtight seal (e.g., via heat sealing) and make bag 600 airtight. Structurally weakened region 630 may be formed adjacent to seals area 628 to allow a user to remove seal area 628 and access the contents of bag 600.

Figure 7:
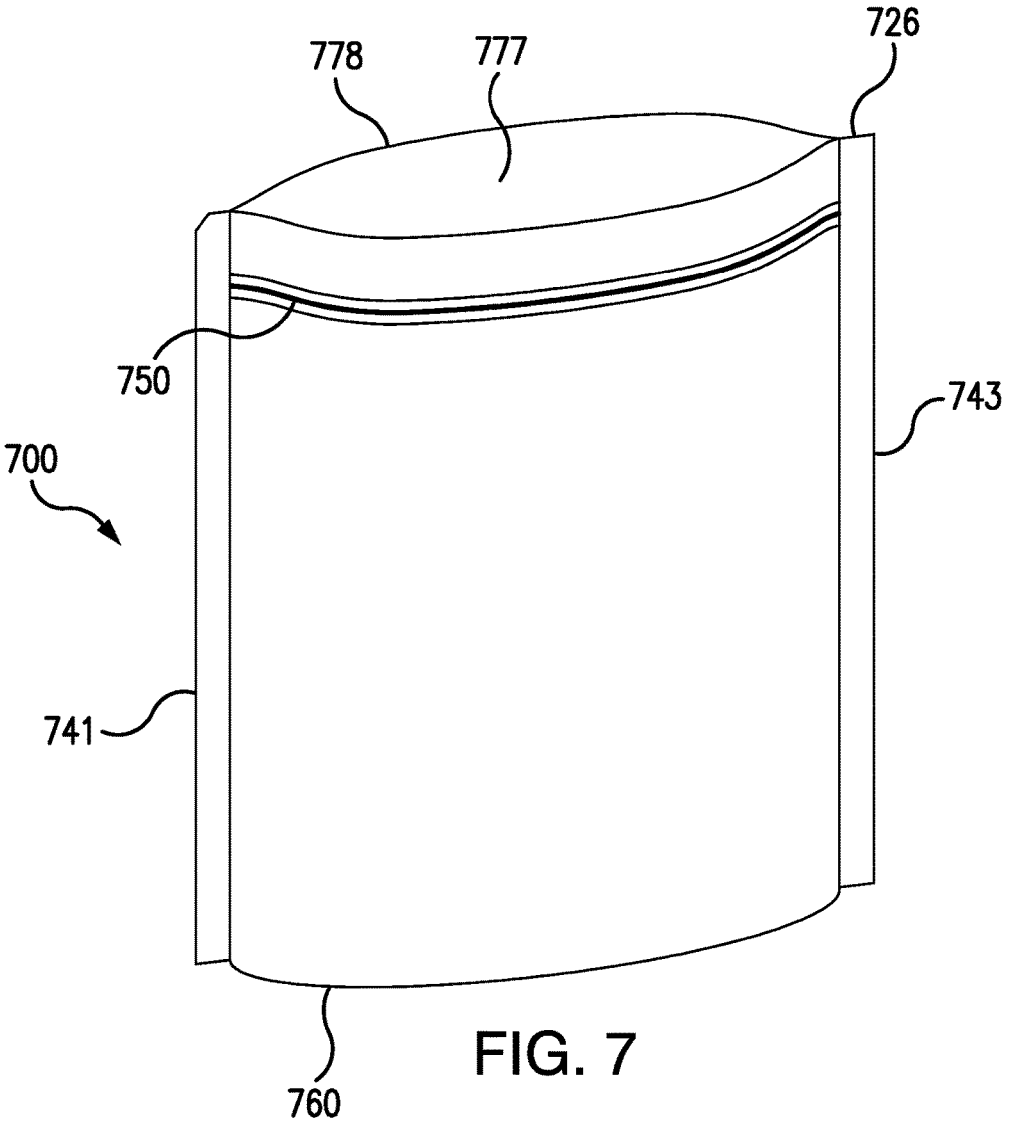
FIG. 7 shows a perspective view of a resealable bag according to an embodiment.

FIG. 7 depicts a bag 700 with an opening 778 defined by an upper edge 726 according to an embodiment. Opening 778 provides users access to a hollow interior 777 of bag 700. A first side edge 741 and a second side edge 743 may define the sides of bag 700 and may extend from a closed bottom 760 to upper edge 726. A user may fill hollow interior 777 of bag 700 with contents. In some embodiments, hollow interior 777 may be prefilled with contents. A resealable closure 750 may be disposed at a range of distances from opening 778. Resealable closure 750 allows a user to repeatedly open and close bag 700. A user may keep bag 700 over a period of use and be able to reseal bag 700 after each use. The structure and location of resealable closure 750 may be the same as or similar to resealable closure 450.

Figure 8:
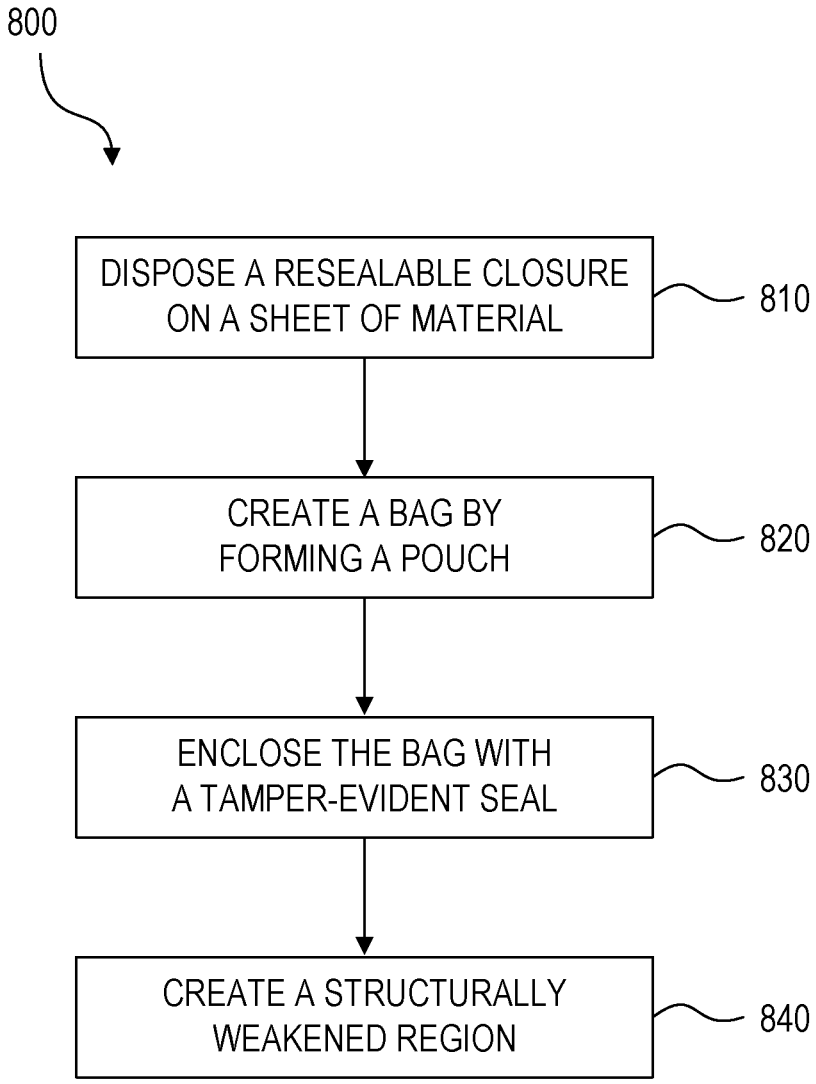
FIG. 8 shows a flow diagram of a method according to an embodiment.

FIG. 8 depicts a method 800 for making a bag. The order of the processes discussed below is exemplary and may be rearranged depending on a number of factors, for example, but not limited to, optimization of the assembly process and the layout (e.g., the location of equipment and/or process flow) of a production floor.

In step 810, a resealable closure (e.g., resealable closure 650) may be disposed on an interior surface of a sheet, film, laminate, etc. (e.g., interior surfaces 607 shown in FIG. 6) used to form a bag. In some embodiments, resealable closure 650 may be sealed to interior surfaces 607 using, for example, an adhesive or heat sealing. Resealable closure 650 may be disposed on interior surfaces 607 of a first sidewall (e.g., first sidewall 611) and a second sidewall (e.g., second sidewall 612). Resealable closure 650 may include a male component (e.g., male component 652) disposed 1 to 2 inches downward from a lower edge of a tamper-evident seal (e.g., tamper-evident seal 620) and a female component (e.g., female component 654) disposed 1 to 2 inches downward from a lower edge of tamper-evident seal 620. In some embodiments, step 810 may include disposing female component 654 on a first flange and male component 652 on a second flange. In some embodiments, step 810 may include disposing more than one resealable closure 650 on interior surfaces 607. In some embodiments, tamper-evident seal 620 may be removable.

Step 820 may include creating a bag by forming a pouch by coupling a first sidewall (e.g., sidewall 611) to a second sidewall (e.g., sidewall 612). In embodiments including a continuous sheet/film/laminate, a closed bottom may be formed when first sidewall and second sidewall are sealed together (e.g. sealing together sidewalls 611 and 612 at the bottom). In embodiments including a continuous sheet/film/laminate, a closed bottom may be formed by folding/gusseting the material to form a closed bottom. In some embodiments, a separate sheet may be used for first sidewall, second sidewall, and the closed bottom. Gussets (e.g., gussets 655) may be added to help form the shape of the bottom of the bag. Gussets may provide structural stability for the bag so that it can stand upright and resist tipping over.

After forming a pouch in step 820, the bag may be enclosed and sealed in step 830 by forming a tamper-evident seal 620 at an upper end of the pouch. Before enclosing and sealing the bag in step 830, contents may be added to the bag. By sealing the bag, the bag may be made airtight. Tamper-evident seal 620 may be formed by sealing the top portions of a bag (e.g., seal area 628) together.

In step 840, a structurally weakened region (e.g., structurally weakened region 630) may be created at an upper end of the bag. Structurally weakened region 630 may be disposed between seal area 628 and resealable closure 650. Creating the structurally weakened region may include perforating first sidewall 611 and second sidewall 612 with a laser scoring process. Other weakening methods may be employed as well. Structurally weakened region 630 may define an opening at the upper end of the bag when tamper-evident seal 620 is removed.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention(s) and the appended claims in any way.

The present invention(s) has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A resealable bag comprising:

a first sidewall;

a second sidewall connected to the first sidewall to form a closed bottom, the sidewalls coupled together along their side edges and extending upwardly from the closed bottom to form an upper end of the bag;

a tamper-evident seal disposed along the upper end of the bag;

a resealable closure disposed along interior surfaces of the first and second sidewalls between 1 inch to 2 inches below a lowermost edge of the tamper-evident seal, the resealable closure comprising a first closure component and a second closure component;

a first flange coupled to the first sidewall, the first flange comprising an upper edge and a bottom edge, the upper edge of the first flange being disposed 2.0 inches from the lowermost edge of the tamper-evident seal, wherein the upper edge of the first flange is sealed to the first sidewall and the bottom edge of the first flange is not sealed to the first sidewall; and a second flange coupled to the second sidewall, the second flange comprising an upper edge and a bottom edge, the upper edge of the second flange being disposed 2.0 inches from the lowermost edge of the tamper-evident seal, wherein the upper edge of the second flange is not sealed to the second sidewall and the bottom edge of the second flange is sealed to the second sidewall;

wherein the first closure component is disposed on the first flange and the second closure component is disposed on the second flange.

2. The resealable bag of claim 1, wherein the resealable closure comprises two or more first closure components coupled to the first sidewall and two or more second closure components coupled to the second sidewall.

3. The resealable bag of claim 1, further comprising at least two gussets disposed at the closed bottom and configured to support the bag in an upright position.

4. The resealable bag of claim 1, wherein the resealable closure is a zipper.

5. The resealable bag of claim 1, further comprising:

a first interior set of ridges disposed on the first flange below the first closure component and the spaced apart from each other by a first distance and a first exterior set of ridges disposed on the first flange above the first closure component and spaced apart from each other by a second distance; and a second interior set of ridges disposed on the second flange below the second closure component and spaced apart from each other by the first distance and a second exterior set of ridges disposed on the second flange above the second closure component and spaced apart from each other by the second distance.

6. The resealable bag of claim 5, wherein the first distance is less than the second distance.

7. The resealable bag of claim 5, wherein the first closure component and the second closure component extend substantially further from the first and second flanges, respectively, than the interior and exterior ridges, thereby creating a space between the flanges when the first and second closure components of the closure are engaged.

8. The resealable bag of claim 5, wherein the first interior set of ridges and the second interior set of ridges are paired up;

wherein the first exterior set of ridges and the second exterior set of ridges are paired up; and wherein for each pair of the ridges, one on each of the first and second flanges, the distance from the ridge on the first flange to the resealable closure is the same as the distance from the ridge on the second flange to the resealable closure.

9. The resealable bag of claim 1, wherein the tamper-evident seal is coupled to the first sidewall and the second sidewall by a structurally weakened region.

10. The resealable bag of claim 9, wherein the structurally weakened region comprises a laser scored line of perforation.

11. The resealable bag of claim 9, further comprising a tear notch disposed adjacent to the structurally weakened region.

12. The resealable bag of claim 1, wherein a vertical distance between the tamper-evident seal and the resealable closure is greater than a vertical distance from a top end of the tamper-evident seal to a bottom end of the tamper-evident seal.

13. The resealable bag of claim 1, wherein the resealable closure is disposed closer to a bottom edge of the first flange and a bottom edge of the second flange than an upper edge of the first flange and an upper edge of the second flange, respectively.

14. The resealable bag of claim 1, wherein the first closure component is a female component and wherein the second closure component is a male component.

* * * * *